United States Patent [19]

Dietrich et al.

[11] 4,108,482

[45] Aug. 22, 1978

[54] DISENGAGING SPINDLE LOCKING MECHANISM

[75] Inventors: Hagen Dietrich, Delta; William J. Fane, North Vancouver; Joseph Potschka, Vancouver, all of Canada

[73] Assignee: Norris Industries, South Gate, Calif.

[21] Appl. No.: 843,939

[22] Filed: Oct. 20, 1977

[51] Int. Cl.[2] ..... E05B 55/06

[52] U.S. Cl. ..... 292/165; 70/472; 70/149; 70/218; 292/169.16; 292/336.5; 292/DIG. 27

[58] Field of Search ..... 292/165, 169.16, 169.18, 292/169.22, 336.5, DIG.27; 70/471, 472, 486, 487, 149, 218, 222, 223

[56] References Cited

U.S. PATENT DOCUMENTS

| | | | |
|---|---|---|---|
| 1,387,888 | 8/1921 | Holt | 292/DIG. 27 |
| 1,651,018 | 11/1927 | Drees et al. | 292/DIG. 27 |
| 1,968,285 | 7/1934 | Egan | 70/149 X |
| 2,030,630 | 2/1936 | Gram | 70/149 X |
| 2,469,601 | 5/1949 | Lee | 292/DIG. 27 |
| 3,211,486 | 10/1965 | Crandell | 292/169.16 X |
| 3,750,433 | 8/1973 | Sanders | 292/165 X |

FOREIGN PATENT DOCUMENTS

| | | | |
|---|---|---|---|
| 803,698 | 4/1951 | Fed. Rep. of Germany | 292/DIG. 27 |

*Primary Examiner*—Rodney H. Bonck

[57] ABSTRACT

A disengaging spindle locking mechanism for the latch bolt of a mortise type lock is actuated by the locking slide which is normally employed to engage a retractor hub to prevent the hub from being rotated. At the inner end of a split spindle where it is in non-rotatable engagement with the retractor hub there is a cam surface. On the inner end of a locking slide is a cam surface which cams the spindle out of engagement with the hub as hub action is blocked by the slide. Thereafter, should force be applied to the spindle, it will merely spin in place and no damage will be done to the lock mechanism such as might otherwise be done by unauthorized persons to force open the lock.

9 Claims, 5 Drawing Figures

Fig. 3.
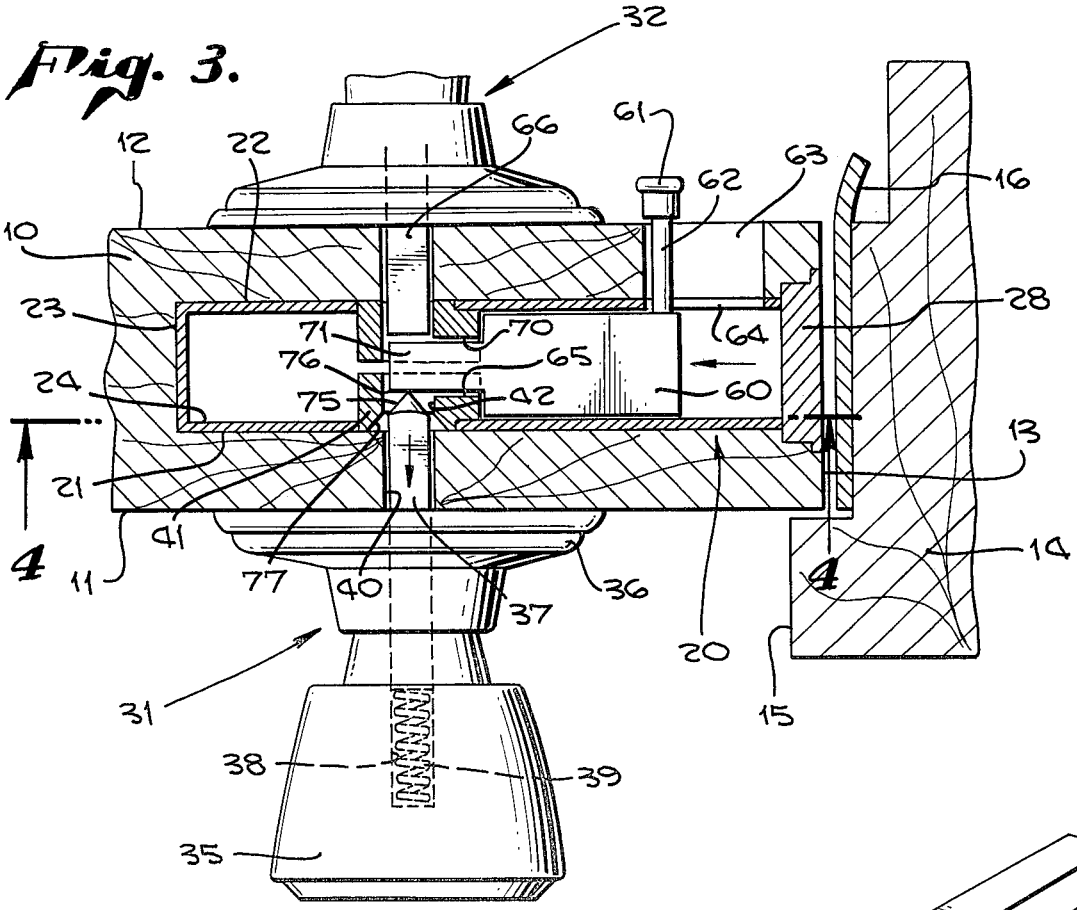
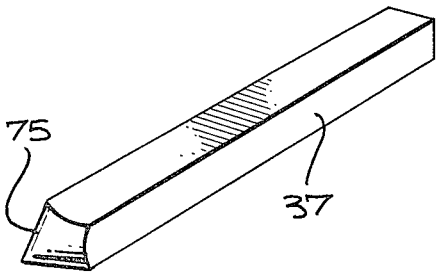
Fig. 5.
Fig. 4.
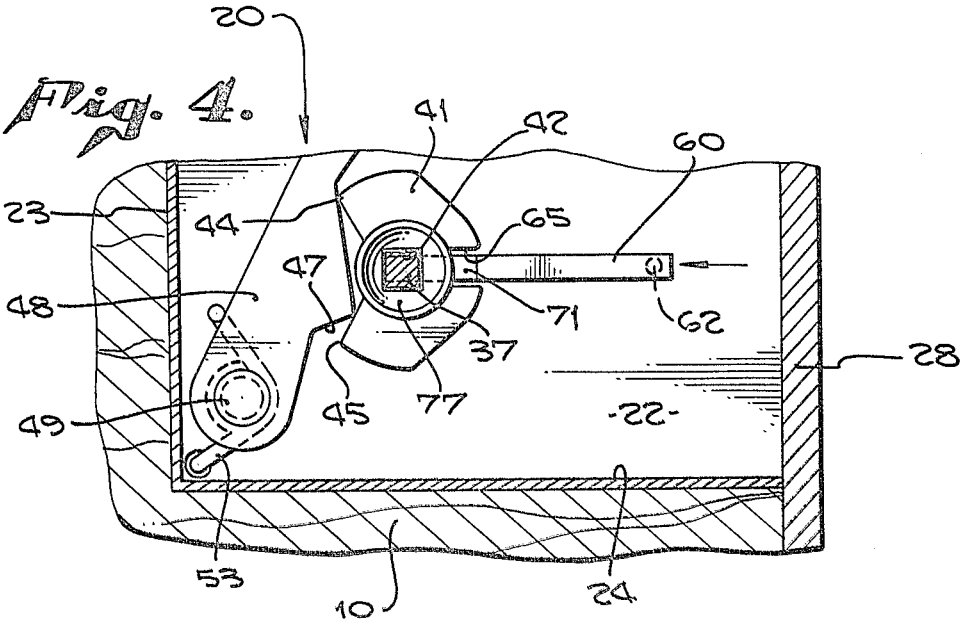

DISENGAGING SPINDLE LOCKING MECHANISM

Despite the advantages of security in mortise type locks, wherein a latch bolt of the reciprocating type is so arranged as to penetrate rather deeply into a latch bolt aperture in the strike plate, knowledgeable unauthorized persons are still tempted to manipulate the lock in order to gain a forcible entry. In some locks of the kind made reference to, of which a mortise type lock is a typical example, the lock mechanism can sometimes be damaged sufficiently to make it possible for such an unauthorized person to withdraw the latch bolt far enough to force the door open. Such forcible entry is easier when the handhold secured to a conventional spindle on the exterior of the trim is a lever type handhold which gives such person appreciable mechanical advantage to forcibly rotate the spindle and in that way to damage the mechanism. Even without such a mechanical advantage being present, a conventional round knob can be rotated with considerable force by application of a pipe wrench.

Some expedients undertaken to overcome the disadvantage have been to appreciably strengthen the locking mechanism making all relatively moving parts heavier and stronger, sufficient at least to minimize the damage when a lever handle is rotated forcibly to gain unauthorized entry. Another remedy has been to add a complicated overload release apparatus. Although the latter expedient can often be counted upon for effectiveness, there is appreciable cost involved in supplying such additional overload release parts as well as the cost of assembling them in a lock with sufficient accuracy to have them dependable. Both expedients which have been made reference to add materially to the cost of manufacture which ultimately must be passed on to the purchaser.

It is, therefore, among the objects of the invention to provide a new and improved non-complicated mechanism with attendant low cost, capable of nullifying the damaging effect of forcibly rotating the handhold and attached spindle in order to gain forcible entry.

Another object of the invention is to provide a new and improved disengaging spindle locking mechanism for a latch bolt which is locked by lever action which is of such character that when locked, the spindle attached to the outside handhold is completely disengaged, but so arranged that once the mechanism has been unlocked, reengagement takes place instantly and automatically.

Still another object of the invention is to provide a new and improved disengaging spindle locking mechanism for a latch bolt which is capable of completely and effectively disengaging the spindle from the latch retracting mechanism by merely a relatively minor structural revision of the necessary elements of the locking mechanism, whereby to minimize the number of parts and the accompanying cost.

Still further among the objects of the invention is to provide a new and improved disengaging spindle locking mechanism for a latch bolt in an arrangement which gives positive assurance of the handhold being disconnected on all occasions when the latch bolt is secured in locked position, the rearrangement further being such that only relatively minor changes need to be made in conventional locking mechanisms.

With these and other objects in view, the invention consists of the construction, arrangement, and combination of the various parts of the device serving as an example only of one or more embodiments of the invention, whereby the objects comtemplated arc attained, as hereinafter disclosed in the specification and drawings, and pointed out in the appended claims.

FIG. 3 is a sectional view similar to FIG. 1, but showing the device in locked condition.

FIG. 4 is a sectional view taken on the line 4—4 of FIG. 3.

FIG. 5 is a perspective view of a typical spindle used in the device.

Figure 1:
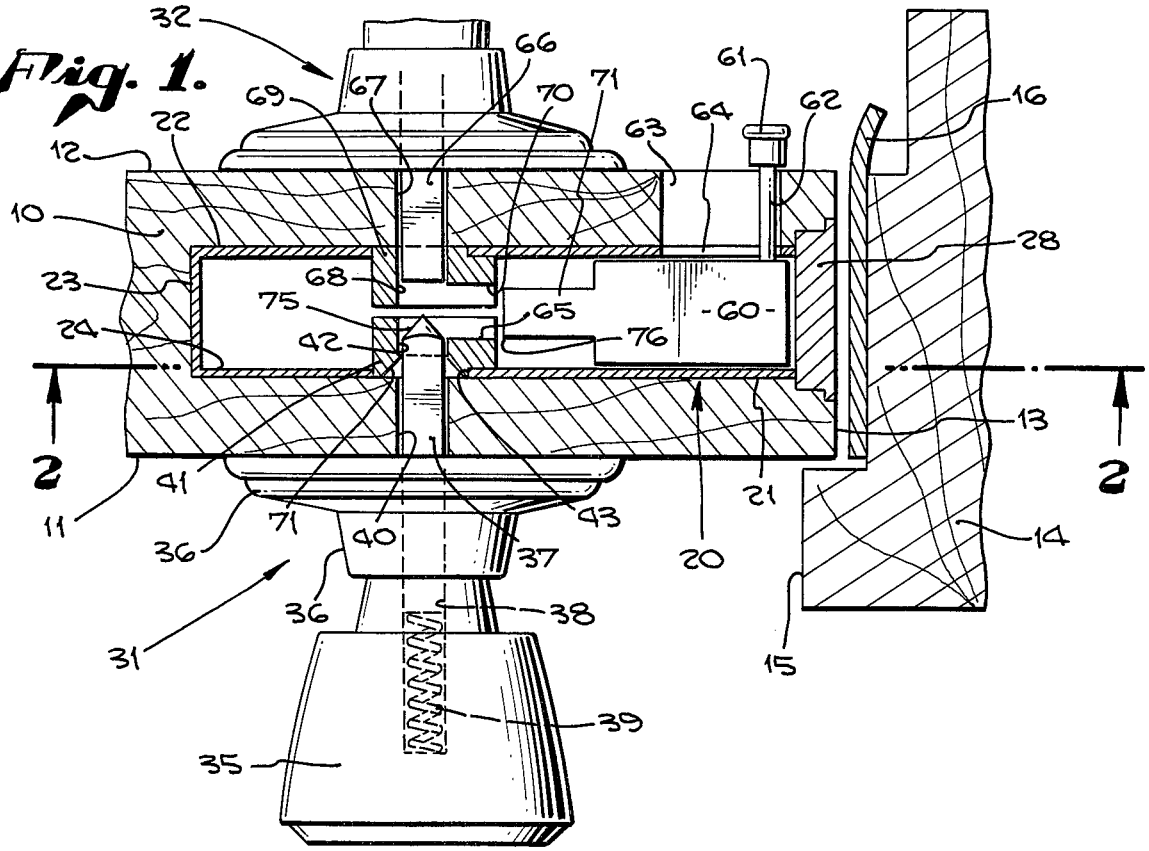
FIG. 1 is a horizontal sectional view through a fragment of doorway and accompanying jamb showing a lock provided with the disengaging spindle locking mechanism in unlocked condition.

In an embodiment of the invention wherein the basic essentials of a characteristic mortise type lock have been shown by way of example of many locks of this same general character, there is shown a door 10 having an outer face 11, an inner face 12 and an edge face 13. The door 10 is shown in cooperation with a jamb 14 having a stop 15 and a strike plate 16.

A mortise type lock, indicated generally by the reference character 20, is shown contained in a housing serving as a frame comprising in the chosen example an outside wall 21, an inside wall 22 and an end wall 23. The housing is adapted to fit within a substantially rectangular recess 24 which extends inwardly from the edge face 13 of the door.

The mortise type lock is provided with a latch bolt consisting of a latch bolt head 25 and a shaft 26, the latch bolt being reciprocatably mounted in the housing which serves as a frame, mounting details having been omitted in the interest of simplicity. The latch bolt head is adapted to extend through a hole 27 in a front edge plate 28 which is part of the housing of the mortise type lock.

Figure 2:
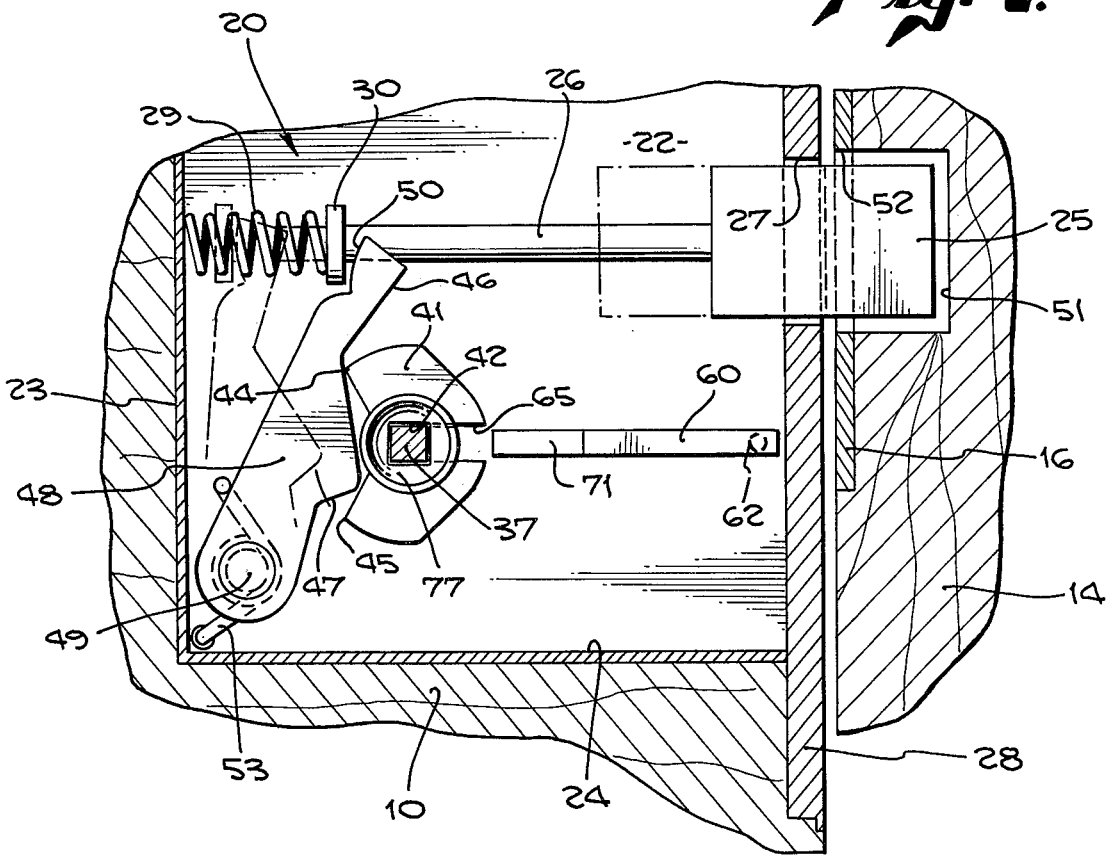
FIG. 2 is a vertical sectional view taken on the line 2—2 of FIG. 1.

In one form of mounting such as that shown, there may be provided a compression spring 29 acting between the end wall 23 and a collar 30 on the shaft 26 biased in a direction extending the latch bolt to locked position, as shown in FIG. 2.

For manipulating the latch bolt, there is provided an outside trim 31 and an inside trim 32. In the chosen embodiment the outside trim 31 is shown served by a handhold in the form of a knob 35 rotatably mounted on an outside rose assembly 36 which is fastened to the door in a customary conventional fashion. An outside spindle 37, non-circular in cross section, has an axially slidable engagement with the outside knob 35, but due to its non-circular shape and fitting within a non-circular opening 38 is in non-rotatable engagement with the knob 35. A coil compression spring 39 in the opening 38 acting between the bottom of the opening and the outside end of the spindle 37 is biased in a direction urging the spindle axially inwardly toward the mortise type lock 20. In the chosen embodiment the non-circular shape of the spindle and its opening is square. The shape, however, can be virtually any other non-circular shape, such, for example, as hexagonal, multi-sided, or knurled, so long as it provides a clutch type non-rotatable engagement and is capable of sliding in an axial or endwise direction.

The outside spindle 37 is of such length that it extends through a hole 40 in the door inwardly to a position within the mortise type lock where it is in axially slidable and non-rotatable engagement with a hub 41, by virtue of engagement in a non-circular opening 42 in the hub.

The hub 41 has a rotatable mounting in a recess 43 in the outside wall 21 of the housing. When the hub 41 is rotated, either clockwise or counter-clockwise by manipulation of the knob 35, the hub 41 is rotated in a corresponding direction such that the shoulder 44 or the shoulder 45 as the case may be moves against a corresponding cam track 46 or 47 causing counter-clockwise rotation as viewed in FIG. 2 of a retract arm 48 about its pivot point 49 in the mortise type lock housing. When moved as described, a cam follower 50 at the end of the retract arm 48 moves against a corresponding side of the collar 30 which shifts the latch bolt in a direction from right to left as viewed in FIG. 2, for example, thereby to withdraw the latch bolt head 25 from latch bolt holes 51 and 52 respectively in the jamb 14 and strike plate 16. When the knob 35 is released, a torsion spring 53 acting between the mortise lock housing and the retract arm 48 causes the retract arm to move in a clockwise direction as viewed in FIG. 2, which has the effect in acting upon the hub 41 to return it to initial position. At the same time, energy stored in the spring 29 serves to return the latch bolt to the extended locked position of FIG. 2.

To hold a latch bolt in the locked position, there is provided a locking slide 60, the locking slide being mounted in the housing of the mortise lock in a substantially conventional fashion in which mounting it can be manipulated, by way of example in the embodiment shown, by a locking button 61, a shank 62 of which extends through an opening 63 in the door and a corresponding opening 64 in the inside wall of the mortise lock so that the locking button can be manipulated from the inside.

In order for the locking slide to block rotation of the hub 41 and consequently prevent withdrawal of the latch bolt to unlocked position, there is provided in the hub 41 a radially extending locking slot 65. The slot 65 extends all the way from the exterior into communication with the non-circular opening 42 within the housing, in which the spindle 37 is located.

Also by way of example, for manipulating the latch bolt by operation of the inside trim 32, the inside trim is provided with a spindle 66 corresponding in general shape and size to the spindle 37. The spindle 66 extends through a hole 67 in the door 10 and into a similarly shaped non-circular opening 68 in an inside hub 69. Like the outside hub 41, there is provided in the inside hub a radially extended slot 70 which is also adapted to accommodate the locking slide 60. More particularly, the locking slide has a reduced end portion 71 which is the part depended upon to simultaneously enter the radially extending slots 65 and 70. Therefore, when the reduced end portion 71 is projected into the slots 65 and 70, rotation of both the hub 14 and the hub 69 is blocked, and the latch bolt head 25 cannot be withdrawn. To unlock the lock, permitting withdrawal of the latch bolt head, all that is necessary is to shift the locking button 61 in a direction from left to right as viewed in FIG. 1. This motion frees the reduced end portion 71 from engagement with the hubs and manipulation of either the outside knob 35 or an appropriate handhold on the inside trim 32 withdraws the latch bolt head so that the door can be opened.

To prevent mutilation of the locking mechanism by application of unauthorized force to the outside handhold such, for example, as the knob 35, or a lever handle which might be substituted for the knob 35, the mechanism is such as to shift the outside spindle 37 out of engagement with the outside hub 41. Shifting of the spindle is accomplished by providing at the inside end of the spindle a conical end which results in an oblique face 75 serving as a cam follower, facing the inside end of the reduced end portion 71 of the locking slide 60. A corner 76 on the reduced end portion serving as a cam surface is adapted to engage the oblique face, acting as a cam track or cam way when the locking slide is shifted inwardly to locking position. The camming action thus created serves to shift the outside spindle 37 axially outwardly. Additionally, by providing a countersunk or recessed portion 77 around the non-circular opening 42 in the hub 31, the length of the non-circular opening 42 is shortened appreciably. This serves to minimize the distance outwardly which the outside spindle 37 must travel in order to free the spindle from engagement with the hub. The position just described is shown in FIG. 3, this being locked position. As a consequence, should force be applied to the outside trim as, for example, application of a pipe wrench to the knob 35, the knob will freely spin, since there is no engagement of the spindle with the hub. As a result, no amount of force can be applied sufficient to mutilate the interior locking mechanism and the latch bolt then remains securely locked. Conversely, when the locking slide is withdrawn by manipulation of the locking button 61, the reduced end portion 71 is extracted from the slots in the hubs and by action of the spring 39 the spindle 37 is returned to a position of engagement with the corresponding hub 41 and the outside knob can again be used to withdraw the latch bolt.

Although in the chosen embodiment the inside spindle 66 has not been shown as being provided with the same oblique face as the outside spindle 37, the same construction can be used. Such an expedient might be found desirable under some circumstances, as, for example, when a key action might be substituted for the locking button 61. The inside end of the spindle providing the oblique face 75 might also assume other appropriate configurations providing an oblique face for engagement with the locking slide 60 where a cam surface, acting in substantially the same fashion as the corner of cam surface 76 might be given some other physical configuration.

Having described the invention, what is claimed as new in support of Letters Patent is as follows:

1. In a lock mechanism comprising a frame, a reciprocating latch bolt mounted in the frame, a retract arm movably mounted on the frame in a position of engagement with the latch bolt for withdrawing said latch bolt and a retract hub having a rotatable mounting on the frame in operating engagement with the retract arm, a disengaging spindle locking mechanism for guarding the hub against unauthorized rotation comprising a locking slide having a reciprocatable mounting on the frame, a shoulder on the hub adapted to engage the slide in locking position, means forming a non-circular opening in said hub, a spindle having an axially movable non-rotatable engagement with the non-circular opening in the hub for rotating said hub through a latch bolt actuating cycle, a first cam element on said spindle, a second cam element on an adjacent portion of said slide, said spindle being subject to axial movement by action of said cam elements to a position of disengagement from said hub, whereby to permit rotation of the spindle independent of the hub.

2. A disengaging spindle locking mechanism as in claim 1 wherein said spindle has an inside end located in said hub and said first cam element comprises a cam way at the inside end of the spindle oblique relative to the long axis of the spindle.

3. A disengaging spindle locking mechanism as in claim 2 wherein said non-circular opening in the hub has a countersunk side structure on the side facing outer axial movement of the spindle and adapted to engage said cam way upon movement of the spindle axially in response to action of the locking slide.

4. A disengaging spindle locking mechanism as in claim 1 wherein said second cam element comprises a cam surface on the inside end of the locking slide.

5. A disengaging spindle locking mechanism as in claim 1 wherein said first cam element comprises an oblique face on the inside end of said spindle and said second cam element comprises a shoulder on the inside end of said locking slide.

6. A disengaging spindle locking mechanism as in claim 1 wherein said hub has a radially open slot forming said shoulder on the hub and adapted to receive said locking slide.

7. A disengaging spindle locking mechanism as in claim 1 wherein said second cam element comprises a portion of the locking slide of reduced size and there is a slot in the hub forming said shoulder.

8. A disengaging spindle locking mechanism as in claim 1 wherein there is a spring means acting axially inwardly on the spindle whereby to bias said spindle toward hub engaging position.

9. A disengaging spindle locking mechanism as in claim 1 wherein there is a torsion spring acting on said retract arm in a direction for moving the hub to a latch bolt extended position.

* * * * *